US011363878B1

(12) United States Patent
Agbley

(10) Patent No.: US 11,363,878 B1
(45) Date of Patent: Jun. 21, 2022

(54) SMART PHONE CLIP ASSEMBLY

(71) Applicant: Justice Agbley, Lake Forest Park, WA (US)

(72) Inventor: Justice Agbley, Lake Forest Park, WA (US)

( * ) Notice: Subject to any disclaimer, the term of this patent is extended or adjusted under 35 U.S.C. 154(b) by 0 days.

(21) Appl. No.: 17/244,632

(22) Filed: Apr. 29, 2021

(51) Int. Cl.
*A45F 5/02* (2006.01)

(52) U.S. Cl.
CPC ..... *A45F 5/022* (2013.01); *A45F 2200/0516* (2013.01)

(58) Field of Classification Search
CPC .. A45F 5/022; A45F 2200/0516; A45F 5/021; A45F 2200/0508; A45F 2200/0525; A45C 13/1069; A45C 2011/002; A45C 2011/003; Y10T 24/32; Y10T 24/1382; Y10T 24/13; H01F 7/0263; F16M 13/00; F16M 13/005; G06F 1/166
USPC ..... 224/230, 183
See application file for complete search history.

(56) References Cited

U.S. PATENT DOCUMENTS 3,051,130 A * 8/1962 Morris ..... A45F 5/02 24/11 R
3,741,376 A * 6/1973 Brown ..... A45F 5/02 224/183
4,771,927 A 9/1988 Ventura
5,682,653 A * 11/1997 Berglof ..... G09F 1/10 224/183
6,799,354 B1 10/2004 Goradesky
D644,428 S 9/2011 Feng
9,743,734 B2 * 8/2017 Bemis ..... A45F 5/00
11,212,929 B2 * 12/2021 Mayfield ..... A45C 11/34
2006/0081666 A1 4/2006 Chee
2016/0095402 A1 4/2016 Saad

FOREIGN PATENT DOCUMENTS

WO WO2016027127 2/2016

* cited by examiner

*Primary Examiner* — Adam J Waggenspack

(57) ABSTRACT

A smart phone clip assembly for retaining a smart phone is a shirt pocket includes a yoke that has a pair of pivots each is integrated into the yoke to engage a respective side of a smart phone such that the yoke is pivotally retained on the smart phone. A plurality of first mating members is each coupled to the yoke. A panel is attached to a back side of the smart phone and a plurality of second mating members is each coupled to the panel. The plurality of first mating members is releasably mated to the plurality of second mating members when the yoke is positioned in a closed position thereby inhibiting the smart phone from falling out of the shirt pocket.

6 Claims, 6 Drawing Sheets

FIG. 2
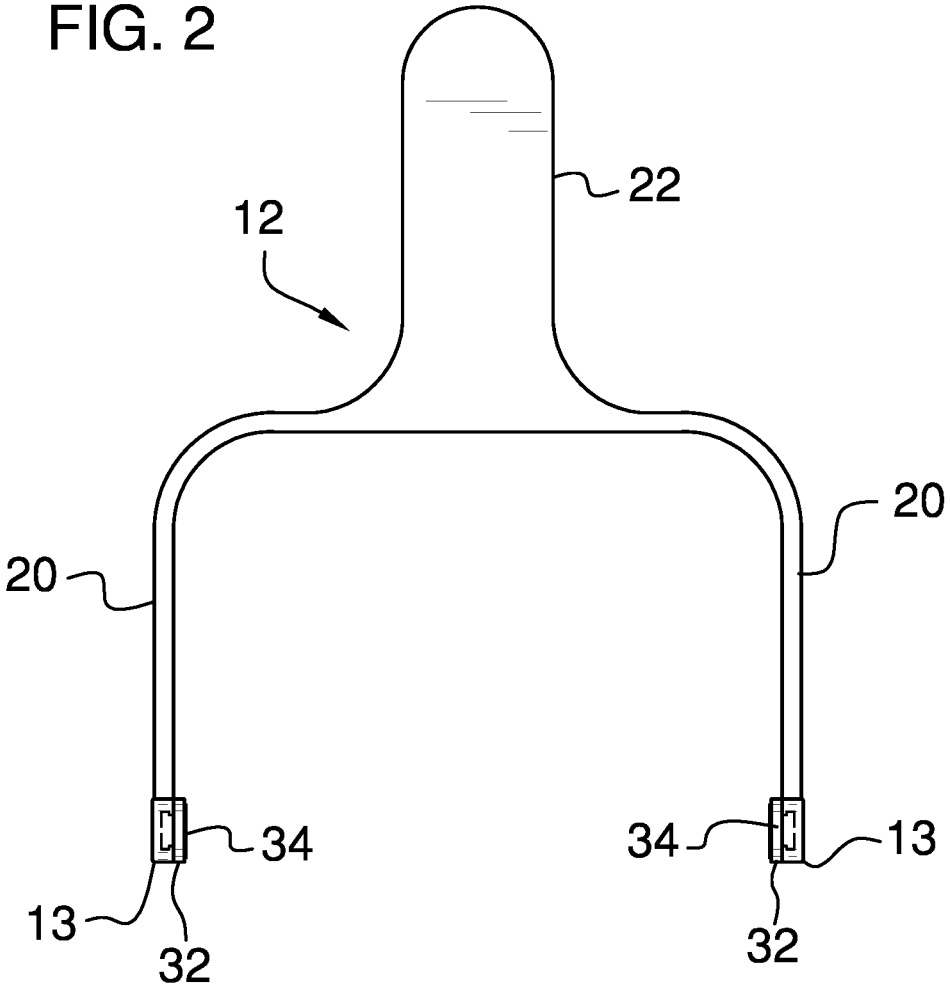
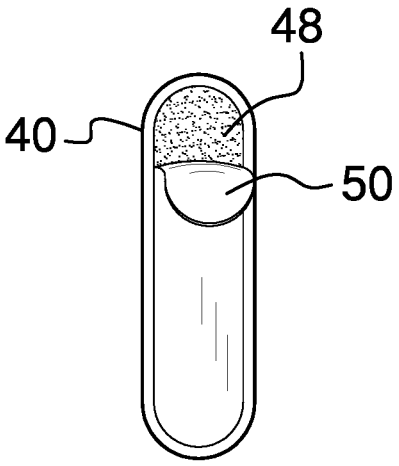
FIG. 3

SMART PHONE CLIP ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to clip devices and more particularly pertains to a new clip device for retaining a smart phone in a shirt pocket. The device includes a yoke that is pivotally attached to a smart phone and a panel that is attached to the smart phone. The yoke is positionable in a closed position to compress a shirt pocket between the yoke and the panel when the smart phone is positioned in the shirt pocket. In this way the smart phone is inhibited from falling out of the shirt pocket.

(2) Description of Related Art Including Information Disclosed Under 37 CFR 1.97 and 1.98

The prior art relates to clip devices including a flexible clasp that is coupled to a case. The flexible clasp is foldable over a shirt pocket and magnetically engages the case through the shirt pocket for inhibiting the case from falling out of the shirt pocket. The prior art discloses a variety of belt clips that are attached to a case for securing the case on a belt or waist band. In no instance does the prior art disclose a yoke that is pivotally attached to a smart phone and which is foldable over a shirt pocket.

BRIEF SUMMARY OF THE INVENTION

An embodiment of the disclosure meets the needs presented above by generally comprising a yoke that has a pair of pivots each is integrated into the yoke to engage a respective side of a smart phone such that the yoke is pivotally retained on the smart phone. A plurality of first mating members is each coupled to the yoke.

A panel is attached to a back side of the smart phone and a plurality of second mating members is each coupled to the panel. The plurality of first mating members is releasably mated to the plurality of second mating members when the yoke is positioned in a closed position thereby inhibiting the smart phone from falling out of the shirt pocket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 2 is a back view of a yoke of an embodiment of the disclosure.

FIG. 3 is a back view of a panel of an embodiment of the disclosure.

DETAILED DESCRIPTION OF THE INVENTION

Figure 1:
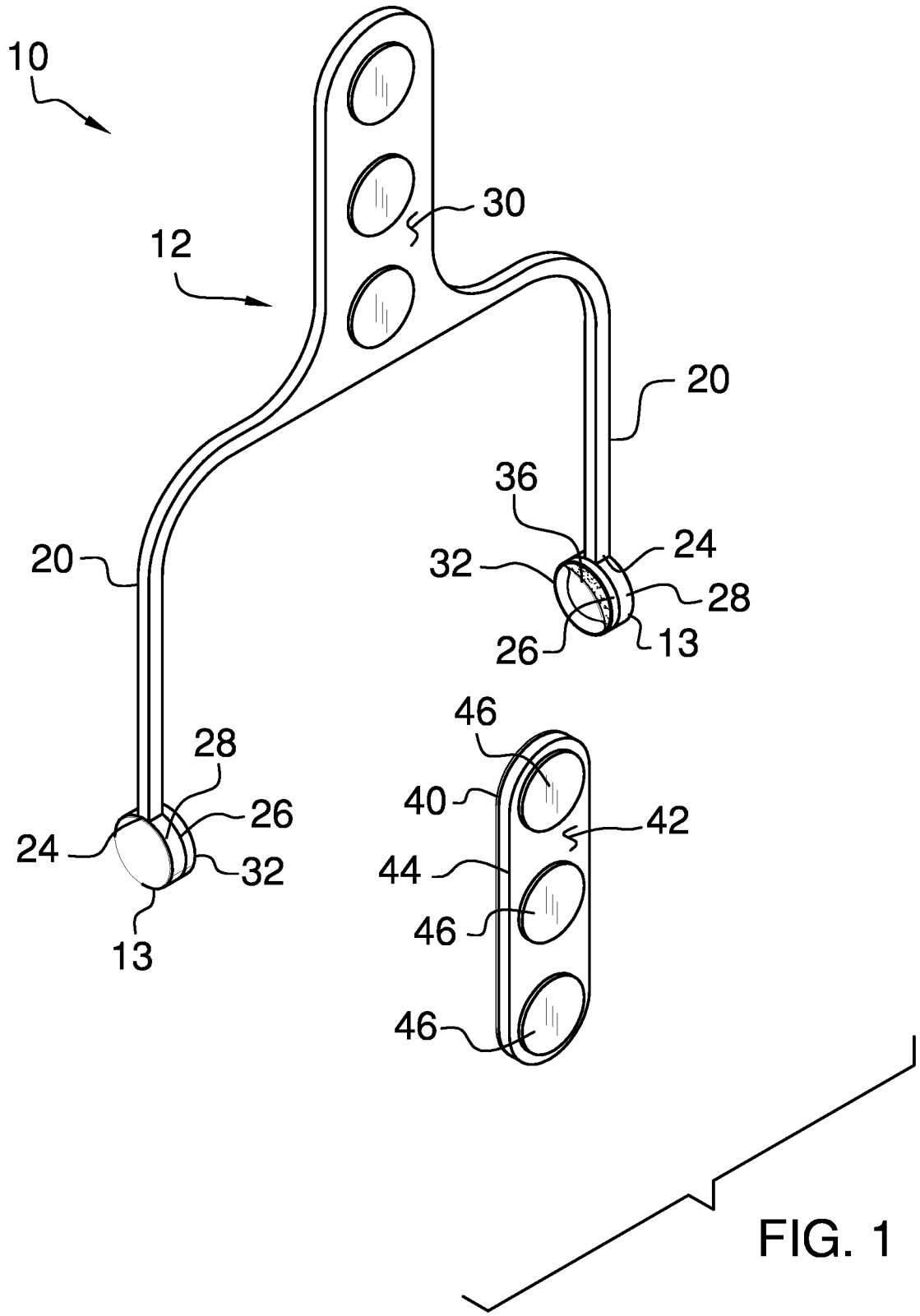
FIG. 1 is a perspective view of a smart phone clip assembly according to an embodiment of the disclosure.
Figure 4:
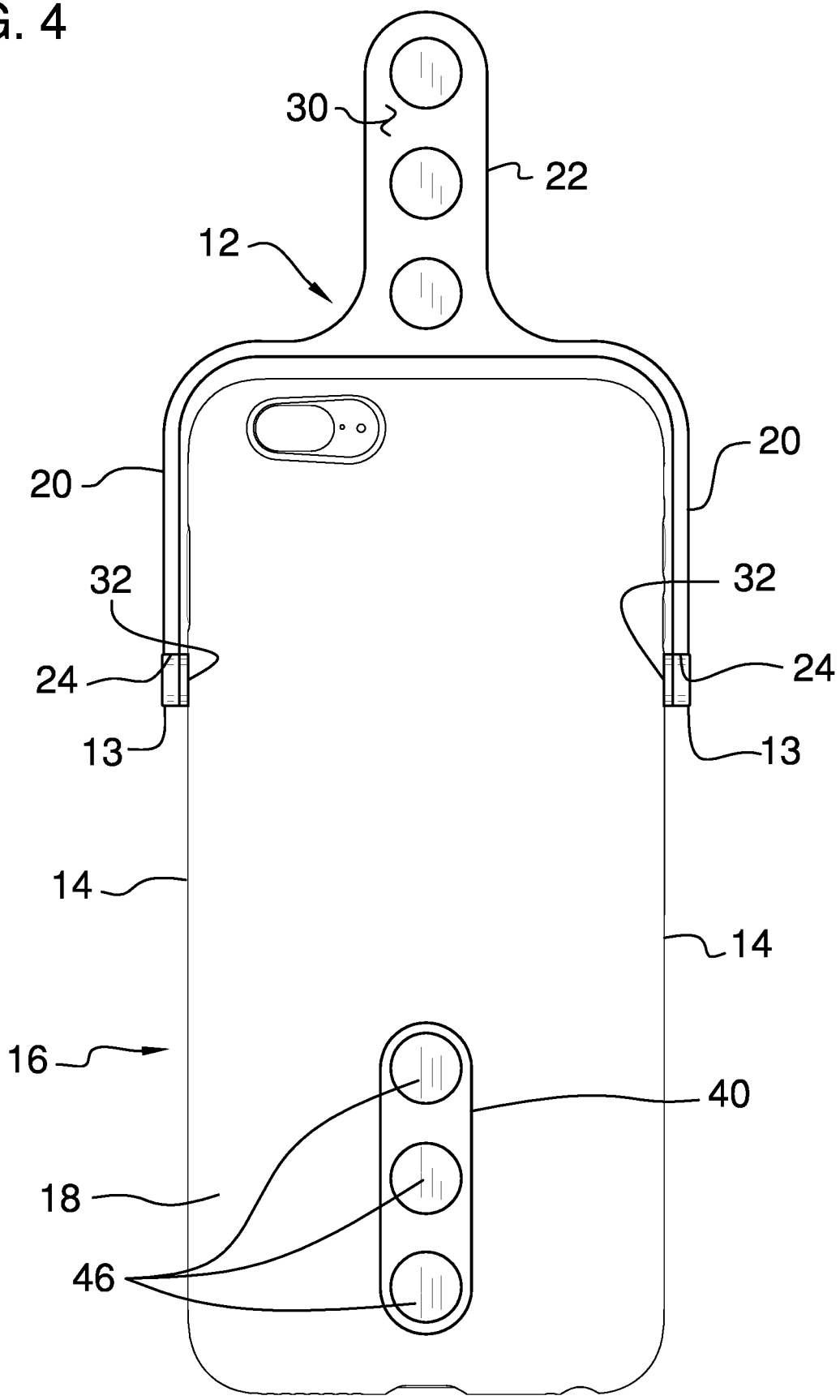
FIG. 4 is a back perspective in-use view of an embodiment of the disclosure showing a yoke in a first position.
Figure 5:
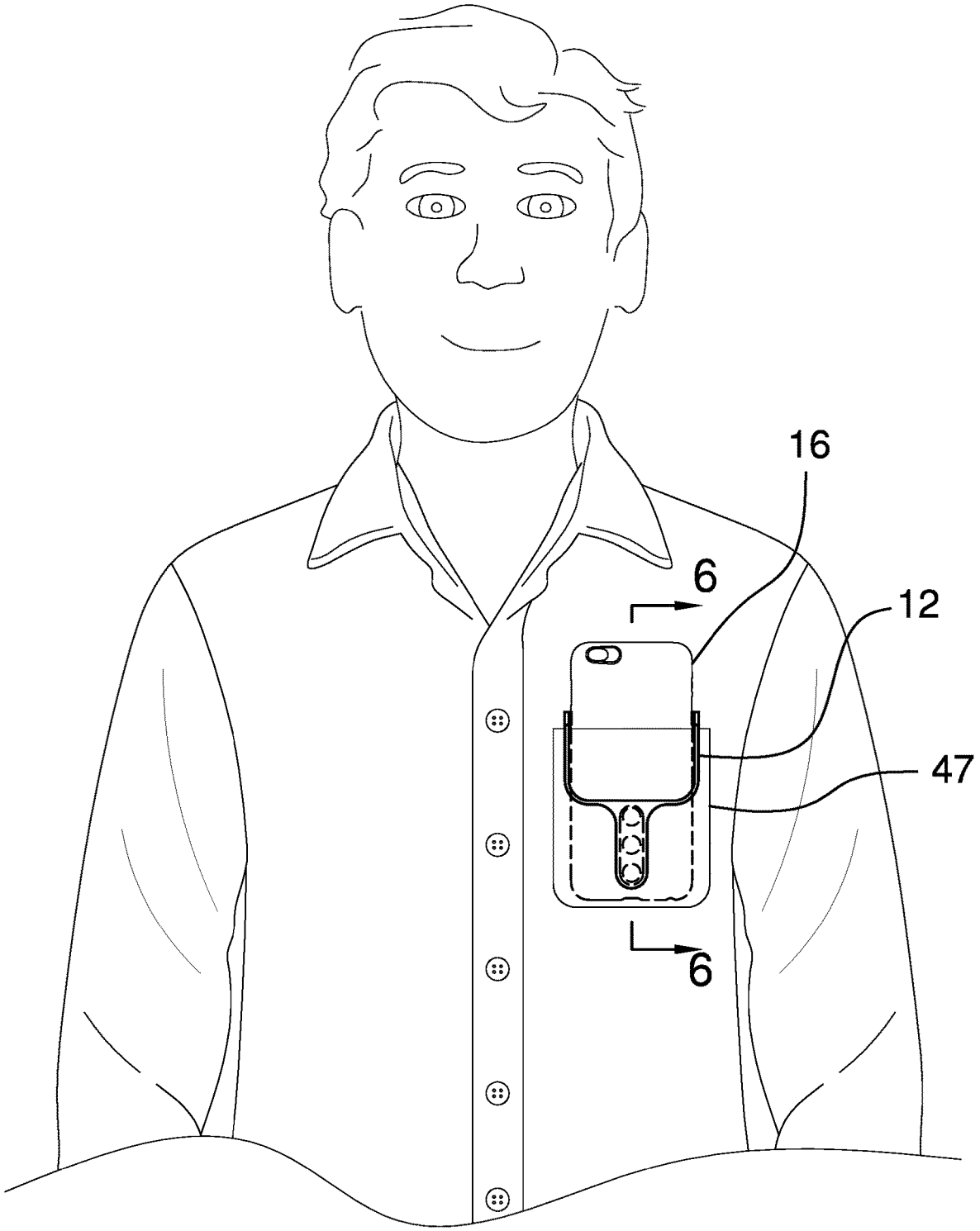
FIG. 5 is a perspective in-use view of an embodiment of the disclosure showing a yoke in a second position.
Figure 6:
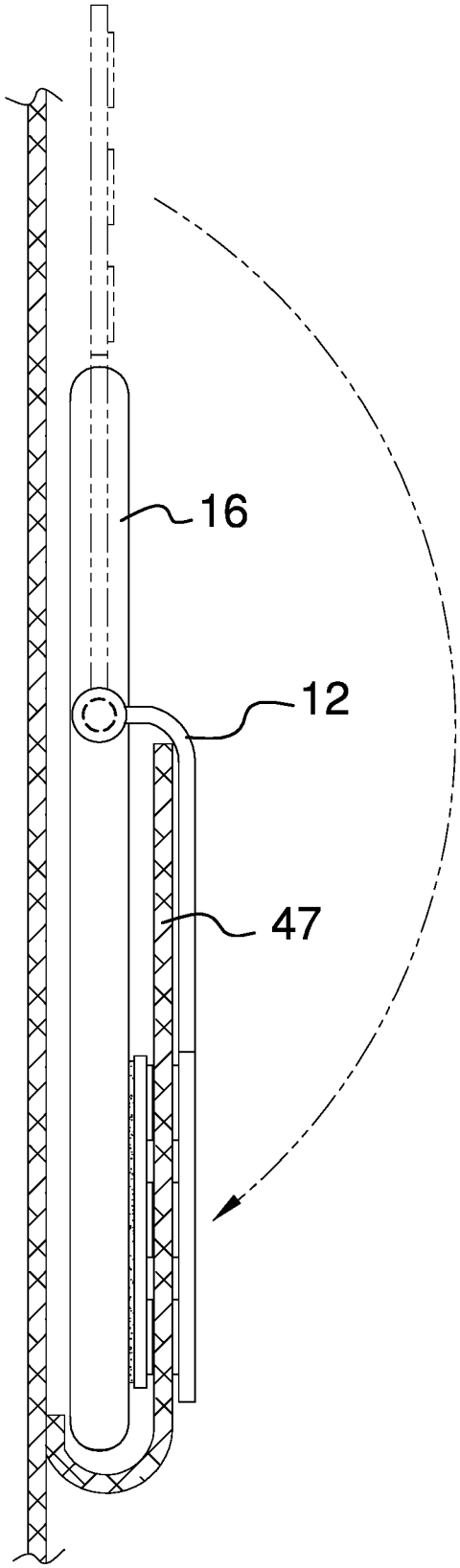
FIG. 6 is a cross sectional view taken along line 6-6 of FIG. 5 of an embodiment of the disclosure.

With reference now to the drawings, and in particular to FIGS. 1 through 7 thereof, a new clip device embodying the principles and concepts of an embodiment of the disclosure and generally designated by the reference numeral 10 will be described.

As best illustrated in FIGS. 1 through 7, the smart phone clip assembly 10 generally comprises a yoke 12 has a pair of pivots 13 each is integrated into the yoke 12 to engage a respective side 14 of a smart phone 16 such that the yoke 12 is pivotally retained on the smart phone 16. The yoke 12 is positionable in a first position having the yoke 12 extending upwardly from the pivots 13 such that the yoke 12 extends upwardly from the smart phone 16. Conversely, the yoke 12 is positionable in a second position having the yoke 12 extending downwardly from the pivots 13 such that the yoke 12 extends downwardly along a back side 18 of the smart phone 16. As is most clearly shown in FIG. 6, the yoke 12 may be comprised of a flexible material.

The yoke 12 has a pair of arms 20 each extending downwardly from a handle 22, the arms 20 are spaced apart from each other and each of the arms 20 has a distal end 24 with respect to the handle 22. Each of the pivots 13 has a first surface 26 and a perimeter edge 28, and the perimeter edge 28 of each of the pivots 13 is coupled to the distal end 24 of a respective one of the arms 20. The first surface 26 of each of the pivots 13 is directed toward each other and the handle 22 has a primary surface 30.

A pair of adhesive pads 32 is each coupled to a respective one of the pivots 13 to adhesively engage the smart phone 16. Each of the adhesive pads 32 is positioned on the first surface 26 of the respective pivot 13 and each of the adhesive pads 32 has an exposed surface 34 with respect to the respective pivot 13. Additionally, each of the adhesive pads 32 is comprised of an adhesive material to adhere to the respective side 14 of the smart phone 16. A pair of protective sheets 36 is each of the protective sheets 36 is removably positioned on the exposed surface 34 of a respective one of the adhesive pads 32 to protect the exposed surface 34 of the respective adhesive pads 32.

A plurality of first mating members 38 is each coupled to the yoke 12 and each of the first mating members 38 is positioned on the primary surface 30 of the handle 22. The first mating members 38 are spaced apart from each other and are distributed along a full length of the handle 22. Each of the first mating members 38 may comprise a magnet or disk made of a ferromagnetic material.

A panel 40 is provided that is attached to a back side 18 of the smart phone 16, and the panel 40 has a first surface 42 and a second surface 44. A plurality of second mating members 46 is each coupled to the panel 40 such that each of the second mating members 46 is positioned in a shirt pocket 47 when the smart phone 16 is inserted into the shirt pocket 47. The plurality of first mating members 38 is releasably mated to the plurality of second mating members 46 when the yoke 12 is positioned in the second position. In this way the yoke 12 compresses the shirt pocket 47 against the panel 40 thereby inhibiting the smart phone 16 from falling out of the shirt pocket 47. Conversely, the plurality of first mating members 38 is unmated from the plurality of second mating members 46 when the yoke 12 is in the first position. In this way the yoke 12 facilitates the smart phone 16 to be removed from the shirt pocket 47.

Figure 7:
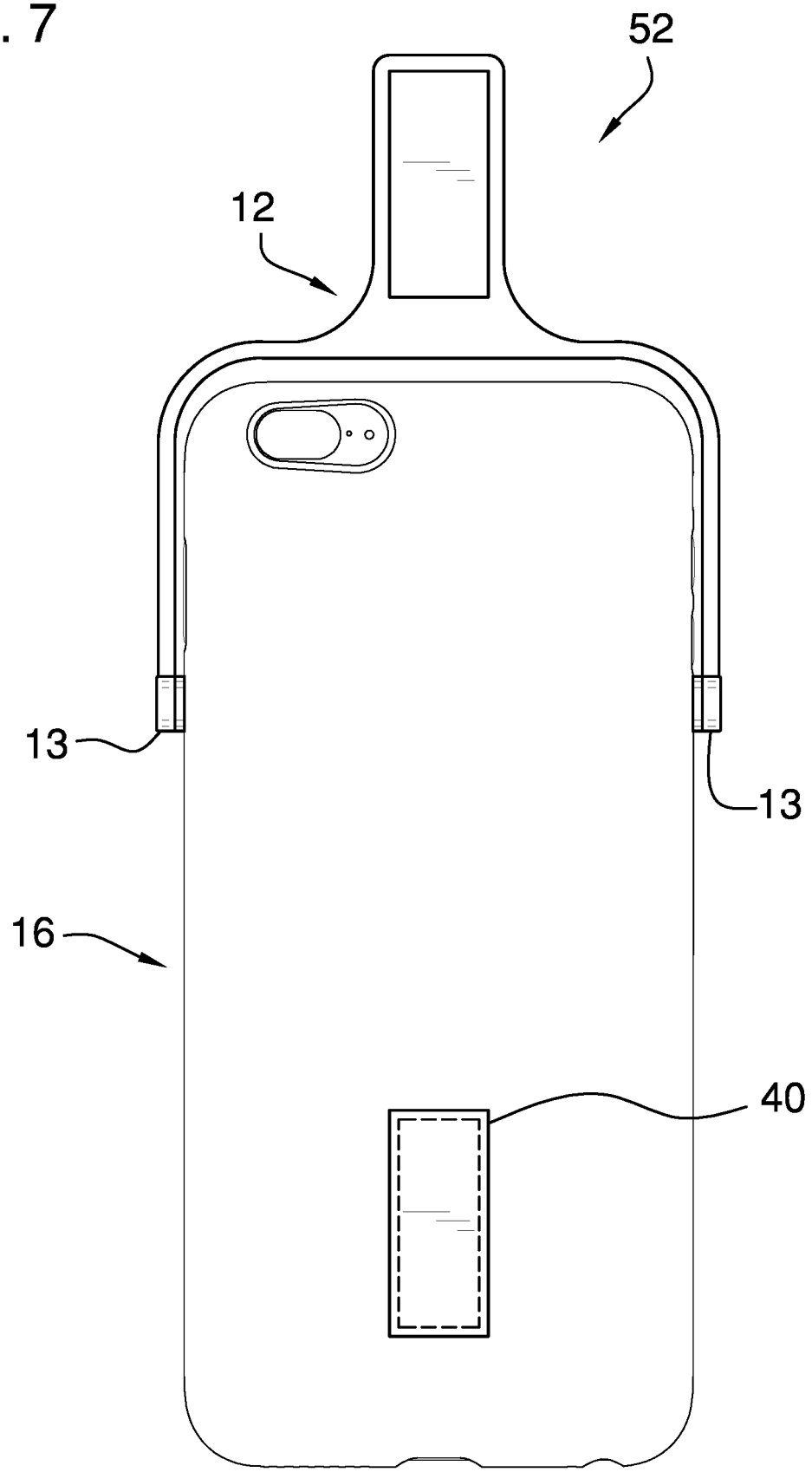
FIG. 7 is a perspective view of an alternative embodiment of the disclosure.

Each of the second mating members 46 is positioned on the first surface 42 of the panel 40, and the second mating members 46 are spaced apart from each other and are distributed along the panel 40. Each of the second mating members 46 may comprise a magnet that can magnetically engage the first mating members 38. An adhesive cushion 48 is coupled to the second surface of the panel 40 and the adhesive cushion 48 has an exposed surface 34 with respect to the second surface 44. The exposed surface 34 of the adhesive cushion 48 adheres to the back side 18 of the smart phone 16, and the adhesive cushion 48 is comprised of an adhesive material. A protective layer 50 is removably positioned on the exposed surface 34 of the adhesive cushion 48 for protecting the exposed surface 34 of the adhesive cushion 48. In an alternative embodiment 52 as is shown in FIG. 7, a single first mating member 38 may be positioned on the handle 22 and a single second mating member 46 may be positioned on the panel 40.

In use, the protective layer 50 is removed from the adhesive cushion 48 and the panel 40 is attached to the back side 18 of the smart phone 16. Each of the protective sheets 36 is removed from the adhesive pads 32 and each of the adhesive pads 32 is adhered to the respective side 14 of the smart phone 16. The yoke 12 is positioned in the second position when the smart phone 16 is positioned in the shirt pocket 47. In this way each of the first mating members 38 compresses the shirt pocket 47 against the second mating members 46 to inhibit the smart phone 16 from falling out of the shirt pocket 47 when a user bends over. The yoke 12 is positioned in the first position to facilitate the smart phone 16 to be removed from the shirt pocket 47.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A smart phone clip assembly for securing a smart phone in a shirt pocket, said assembly comprising:

a yoke having a pair of pivots each being integrated into said yoke wherein each of said pivots is configured to engage a respective side of a smart phone such that said yoke is pivotally retained on the smart phone, said yoke being positionable in a first position having said yoke extending upwardly from said pivots wherein said yoke is configured to extend upwardly from the smart phone, said yoke being positionable in a second position having said yoke extending downwardly from said pivots wherein said yoke is configured to extend downwardly along a back side of the smart phone;

a plurality of first mating members, each of said first mating members being coupled to said yoke;

a panel being configured to be attached to a back side of the smart phone;

a plurality of second mating members, each of said second mating members being coupled to said panel wherein each of said second mating members is configured to be positioned in a shirt pocket when the smart phone is inserted into the shirt pocket, said plurality of first mating members being releasably mated to said plurality of second mating members when said yoke is positioned in said second position wherein said yoke is configured to compress the shirt pocket against said panel thereby inhibiting the smart phone from falling out of the shirt pocket, said plurality of first mating members being unmated from said plurality of second mating members when said yoke is in said first position wherein said yoke is configured to facilitate the smart phone to be removed from the shirt pocket.

2. The assembly according to claim 1, wherein:

said yoke has a pair of arms each extending downwardly from a handle, said arms being spaced apart from each other, each of said arms having a distal end with respect to said handle, each of said pivots having a first surface and a perimeter edge, said perimeter edge of each of said pivots being coupled to said distal end of a respective one of said arms, said first surface of each of said pivots being directed toward each other, said handle having a primary surface; and said assembly includes a pair of adhesive pads, each of said adhesive pads being coupled to a respective one of said pivots wherein each of said adhesive pads is configured to adhesively engage the smart phone, each of said adhesive pads being positioned on said first surface of said respective pivot, each of said adhesive pads having an exposed surface with respect to said respective pivot, each of said adhesive pads being comprised of an adhesive material wherein said exposed surface of each of said adhesive pads is configured to adhere to the respective side of the smart phone.

3. The assembly according to claim 2, wherein each of said first mating members is positioned on said primary surface of said handle, said first mating members being spaced apart from each other and being distributed along a full length of said handle.

4. The assembly according to claim 1, wherein:

said panel has a first surface and a second surface;

each of said second mating members is positioned on said first surface of said panel, said second mating members being spaced apart from each other and being distributed along said panel; and said assembly includes an adhesive cushion being coupled to said second surface of said panel, said adhesive cushion having an exposed surface with respect to said second surface wherein said exposed surface of said adhesive cushion is configured to adhere to the back side of the smart phone, said adhesive cushion being comprised of an adhesive material.

5. A smart phone clip assembly for securing a smart phone in a shirt pocket, said assembly comprising:

a yoke having a pair of pivots each being integrated into said yoke wherein each of said pivots is configured to engage a respective side of a smart phone such that said yoke is pivotally retained on the smart phone, said yoke being positionable in a first position having said yoke extending upwardly from said pivots wherein said yoke is configured to extend upwardly from the smart phone, said yoke being positionable in a second position having said yoke extending downwardly from said pivots wherein said yoke is configured to extend downwardly along a back side of the smart phone, said yoke having a pair of arms each extending downwardly from a handle, said arms being spaced apart from each other, each of said arms having a distal end with respect to said handle, each of said pivots having a first surface and a perimeter edge, said perimeter edge of each of said pivots being coupled to said distal end of a respective one of said arms, said first surface of each of said pivots being directed toward each other, said handle having a primary surface;

a pair of adhesive pads, each of said adhesive pads being coupled to a respective one of said pivots wherein each of said adhesive pads is configured to adhesively engage the smart phone, each of said adhesive pads being positioned on said first surface of said respective pivot, each of said adhesive pads having an exposed surface with respect to said respective pivot, each of said adhesive pads being comprised of an adhesive material wherein said exposed surface of each of said adhesive pads is configured to adhere to the respective side of the smart phone;

a pair of protective sheets, each of said protective sheets being removably positioned on said exposed surface of a respective one of said adhesive pads to protect said exposed surface of said respective adhesive pads;

a plurality of first mating members, each of said first mating members being coupled to said yoke, each of said first mating members being positioned on said primary surface of said handle, said first mating members being spaced apart from each other and being distributed along a full length of said handle;

a panel being configured to be attached to a back side of the smart phone, said panel having a first surface and a second surface;

a plurality of second mating members, each of said second mating members being coupled to said panel wherein each of said second mating members is configured to be positioned in a shirt pocket when the smart phone is inserted into the shirt pocket, said plurality of first mating members being releasably mated to said plurality of second mating members when said yoke is positioned in said second position wherein said yoke is configured to compress the shirt pocket against said panel thereby inhibiting the smart phone from falling out of the shirt pocket, said plurality of first mating members being unmated from said plurality of second mating members when said yoke is in said first position wherein said yoke is configured to facilitate the smart phone to be removed from the shirt pocket, each of said second mating members being positioned on said first surface of said panel, said second mating members being spaced apart from each other and being distributed along said panel;

an adhesive cushion being coupled to said second surface of said panel, said adhesive cushion having an exposed surface with respect to said second surface wherein said exposed surface of said adhesive cushion is configured to adhere to the back side of the smart phone, said adhesive cushion being comprised of an adhesive material; and a protective layer being removably positioned on said exposed surface of said adhesive cushion for protecting said exposed surface of said adhesive cushion.

6. A smart phone clip system for securing a smart phone in a shirt pocket, said assembly comprising:

a smart phone;

a yoke having a pair of pivots each being integrated into said yoke, each of said pivots engaging a respective side of said smart phone such that said yoke is pivotally retained on said smart phone, said yoke being positionable in a first position having said yoke extending upwardly from said smart phone, said yoke being positionable in a second position having said yoke extending downwardly along a back side of said smart phone, said yoke having a pair of arms each extending downwardly from a handle, said arms being spaced apart from each other, each of said arms having a distal end with respect to said handle, each of said pivots having a first surface and a perimeter edge, said perimeter edge of each of said pivots being coupled to said distal end of a respective one of said arms, said first surface of each of said pivots being directed toward each other, said handle having a primary surface;

a pair of adhesive pads, each of said adhesive pads being coupled to a respective one of said pivots, each of said adhesive pads adhesively engaging said smart phone, each of said adhesive pads being positioned on said first surface of said respective pivot, each of said adhesive pads having an exposed surface with respect to said respective pivot, each of said adhesive pads being comprised of an adhesive material to adhere to said respective side of said smart phone;

a pair of protective sheets, each of said protective sheets being removably positioned on said exposed surface of a respective one of said adhesive pads to protect said exposed surface of said respective adhesive pads;

a plurality of first mating members, each of said first mating members being coupled to said yoke, each of said first mating members being positioned on said primary surface of said handle, said first mating members being spaced apart from each other and being distributed along a full length of said handle;

a panel being attachable to a back side of said smart phone, said panel having a first surface and a second surface;

a plurality of second mating members, each of said second mating members being coupled to said panel wherein each of said second mating members is configured to be positioned in a shirt pocket when said smart phone is inserted into the shirt pocket, said plurality of first mating members being releasably mated to said plurality of second mating members when said yoke is positioned in said second position wherein said yoke is configured to compress the shirt pocket against said panel thereby inhibiting said smart phone from falling out of the shirt pocket, said plurality of first mating members being unmated from said plurality of second mating members when said yoke is in said first position wherein said yoke is configured to facilitate said smart phone to be removed from the shirt pocket, each of said second mating members being positioned on said first surface of said panel, said second mating members being spaced apart from each other and being distributed along said panel;

an adhesive cushion being coupled to said second surface of said panel, said adhesive cushion having an exposed surface with respect to said second surface, said exposed surface of said adhesive cushion adhering to said back side of said smart phone, said adhesive cushion being comprised of an adhesive material; and a protective layer being removably positioned on said exposed surface of said adhesive cushion for protecting said exposed surface of said adhesive cushion.

* * * * *